US010598367B2

(12) United States Patent
Klafta et al.

(10) Patent No.: US 10,598,367 B2
(45) Date of Patent: Mar. 24, 2020

(54) LIGHT MODULE

(71) Applicant: OSRAM GmbH, Munich (DE)

(72) Inventors: Thomas Klafta, Maxhutte-Haidhof (DE); Johann Holland, Schernfeld (DE); Martin Loew, Weissenburg (DE); Marcel Vuc, Ingolstadt (DE); Josef Medl, Titting (DE)

(73) Assignee: LEDVANCE GMBH, Garching bei München (DE)

( * ) Notice: Subject to any disclaimer, the term of this patent is extended or adjusted under 35 U.S.C. 154(b) by 83 days.

(21) Appl. No.: 15/448,174

(22) Filed: Mar. 2, 2017

(65) Prior Publication Data

US 2017/0254525 A1 Sep. 7, 2017

(30) Foreign Application Priority Data

Mar. 2, 2016 (DE) ..... 10 2016 203 400

(51) Int. Cl.
*F21V 29/70* (2015.01)
*F21K 9/233* (2016.01)
(Continued)

(52) U.S. Cl.
CPC ..... *F21V 29/70* (2015.01); *F21K 9/20* (2016.08); *F21K 9/233* (2016.08); *F21V 17/101* (2013.01);
(Continued)

(58) Field of Classification Search
CPC . F21V 29/70; F21V 29/89; F21V 9/20; F21V 5/045; F21V 17/101; F21V 23/001;
(Continued)

(56) References Cited

U.S. PATENT DOCUMENTS 8,534,867 B1 * 9/2013 Beadle ..... F21V 17/002 362/153.1
2006/0227558 A1 * 10/2006 Osawa ..... F21V 3/00 362/351
(Continued)

FOREIGN PATENT DOCUMENTS

CN 201028339 Y * 2/2008
CN 201066090 Y 5/2008
(Continued)

OTHER PUBLICATIONS

Machine English Translation of CN201028339Y (Year: 2008).*
Machine English Translation (Espacenet) of DE102012205072A1; Jander; (Year: 2013).*

*Primary Examiner* — Anh T Mai
*Assistant Examiner* — Glenn D Zimmerman
(74) *Attorney, Agent, or Firm* — Hayes Soloway PC

(57) ABSTRACT

A light module serves for inserting into a housing of a semiconductor lamp and comprises: a driver (2), a cooling element, a light generator, abutting the cooling element, with at least one semiconductor light source, which is electrically connected with the driver, and an optical refraction element covering the at least one semiconductor light source, wherein the refraction element is fastened on the cooling element and presses the light generator onto the cooling element. A semiconductor lamp comprises a housing open at the front into which the light module is inserted from the front side and on which the light module is fastened. A method serves for producing a semiconductor lamp, wherein at least the driver, the cooling element, the light generator and the refraction element are assembled into an individually manageable light module and the light module is then inserted into a housing. The invention is also applicable to replacement or retrofit lamps, in particular with a pin base,
(Continued)

particularly a bipin base, e.g. to retrofit lamps for replacing halogen lamps, for example of the type MR16.

20 Claims, 10 Drawing Sheets

(51) Int. Cl.

| | |
|---|---|
| ***F21K 9/20*** | (2016.01) |
| ***F21V 17/10*** | (2006.01) |
| ***F21V 23/00*** | (2015.01) |
| *F21V 17/16* | (2006.01) |
| *F21V 29/89* | (2015.01) |
| *F21Y 115/10* | (2016.01) |
| *F21V 5/04* | (2006.01) |

(52) U.S. Cl.
CPC ..... *F21V 23/005* (2013.01); *F21V 5/045* (2013.01); *F21V 17/164* (2013.01); *F21V 23/001* (2013.01); *F21V 29/89* (2015.01); *F21Y 2115/10* (2016.08)

(58) Field of Classification Search
CPC .... F21V 23/005; F21V 17/164; F21V 23/003; F21V 19/005; F21V 29/503; F21K 9/233; F21K 9/20; F21K 9/90; F21Y 2115/10
USPC ..... 362/235
See application file for complete search history.

(56) References Cited

U.S. PATENT DOCUMENTS

| | | | | |
|---|---|---|---|---|
| 2010/0232164 | A1* | 9/2010 | Tessnow | F21K 9/00 362/294 |
| 2010/0302777 | A1* | 12/2010 | Knoll | F21V 17/06 362/235 |
| 2011/0204780 | A1* | 8/2011 | Shum | H05K 1/189 315/35 |
| 2011/0317428 | A1* | 12/2011 | Paik | F21V 19/0055 362/294 |
| 2013/0070454 | A1 | 3/2013 | Zeng et al. | |
| 2014/0301062 | A1* | 10/2014 | David | F21V 9/30 362/84 |

FOREIGN PATENT DOCUMENTS

| | | | | |
|---|---|---|---|---|
| CN | 204268133 | U | 4/2015 | |
| DE | 102012205072 | A1 * | 10/2013 | F21V 29/83 |
| DE | 102014213388 | A1 | 1/2016 | |
| WO | 2010101405 | A2 | 9/2010 | |
| WO | 2013135837 | A1 | 9/2013 | |
| WO | 2013182659 | A1 | 12/2013 | |
| WO | 2014001110 | A1 | 1/2014 | |

* cited by examiner

LIGHT MODULE

The invention is related to a light module for insertion into a housing of a semiconductor lamp, comprising a driver, a cooling element, a light generator, abutting the cooling element, with at least one semiconductor light source, which is electrically connected with the driver, and an optical refraction element covering the at least one semiconductor light source. The invention is also related to a semiconductor lamp comprising a housing open at the front and the light module. Furthermore, the invention is related to a method for producing a semiconductor lamp. In particular, the invention is applicable to replacement or retrofit lamps, in particular with a pin base, especially a bipin base, e.g. to retrofit lamps for replacing halogen lamps, for example of type MR16 or PAR16.

Until now a LED replacement lamp or retrofit lamp is assembled from several individual elements in many work steps. Due to the individual elements a production in an automatic line is very elaborate or rather impossible. Due to the fastenings of the individual elements very expensive reworking and possibly production stops often occur caused by tolerances and production problems.

For example, FIG. 10 shows the individual elements or components which have to be assembled with each other for manual assembly of an MR16 retrofit lamp 100. Namely, a housing 101 open at the front is provided which comprises a rearward base (here of type GU10). Then a driver 102 is plugged into the housing 101 and thereafter the housing 101 is covered at the front side by a cooling element 103 (also serving for a lid of the housing 101). A TIM film 104 is applied to the cooling element 103 at the front side, a LED module 105 or "light engine" in turn on the TIM film 104. The LED module 105 comprises a circuit board 106 which is laid on the TIM film at the rear side and supports at least one LED 107 at the front side. The at least one LED 107 is covered by a lens 108 which is held by a lens holder 109. The lens holder 109 can be locked in the housing 101 and hold the elements, located between itself and the housing 101, in press fit.

The object of the present invention is to overcome the disadvantages of prior art at least partially.

This object is solved by the features of the independent claims. Preferred embodiments can in particular be learned from the dependent claims.

The object is solved by a module (without loss of generality designated as "light module" in the following) for insertion into a housing of a semiconductor lamp, comprising a driver, a cooling element, a light generator, abutting the cooling element, with at least one semiconductor light source, which light generator is electrically connected with the driver, and an optical refraction element covering the at least one semiconductor light source, the optical refraction element being fastened on the cooling element and pressing the light generator onto the cooling element.

By prefabricating the light module with the different elements or components before insertion into a housing of the semiconductor lamp, an assembly of the semiconductor lamp can be simplified. The light module can particularly be prefabricated separate from the lamp production. Thereby more lamps per hour can be built, because the light module and the housing can be produced parallel. An already existing production line can still be used. There is also the advantage, that a functional test of the light module can take place immediately without the housing. As the light module can be handled and transported independently, it can also be transported in a tray whereby transport influence on solder joints can advantageously be prevented. The finished light module can, for example, be transported in a tray, then introduced in a production line and fully automatically be inserted into the housing. Furthermore, a cost reduction of the elements is possible, because broader tolerances can be realized. By the insertion of the finished light module into the housing the so far common tolerance chain is advantageously interrupted.

The driver can be provided for transforming electrical energy received through a base of the semiconductor lamp to electrical operation signals for operating the at least one semiconductor light source. The semiconductor lamp can be fed e.g. with a line voltage of 230 V alternating current or with a supply voltage of 12 Volt direct current through the base.

The cooling element may also be designated as a heat sink. Advantageously, it consists of metal, e.g. of aluminum. The cooling element can serve as a lid for a housing open at the front.

The light generator can comprise a circuit board which is equipped with the at least one semiconductor light source. In particular, the light generator can abut or lie on the cooling element with a surface of the rear side of the circuit board, namely directly or indirectly (e.g. through a TIM film). Then the circuit board is equipped with the at least one semiconductor light source e.g. only at the front. Such a light generator without further electrical or electronic elements may also be designated as a light source module. Particularly, if the circuit board is additionally equipped with at least one electrical and/or electronic element like an electric resistance, a coil, a capacitor etc., the light generator may also be called a light machine or "light engine".

The light generator abutting the cooling element can include that the light generator (e.g. in a main light radiating direction) abuts the front side of the cooling element or rather the cooling element (e.g. at base side) abuts a rear side of the light generator. Alternatively, the light generator can abut the rear side (e.g. at base side) of the cooling element or rather the cooling element can abut (e.g. in a main light radiating direction positioned) a front side of the light generator. In the latter case the cooling element can comprise at least one opening for passing through the at least one semiconductor light source or for the passage of light which can be emitted by the at least one semiconductor light source.

In a further embodiment the at least one semiconductor light source includes or has at least one light-emitting diode. If several light-emitting diodes are present, these can emit light of the same color or of different colors. A color can be monochrome (e.g. red, green, blue, etc.) or multichrome (e.g. white). The light emitted by the at least one light-emitting diode can also be an infrared light (IR-LED) or an ultraviolet light (UV-LED). Several light-emitting diodes can produce a mixed light; e.g. a white mixed light. The at least one light-emitting diode can contain at least one wavelength-transforming luminescent material (conversion LED). The luminescent material can alternatively or additionally be arranged remote from the light-emitting diode ("remote phosphor"). The at least one light-emitting diode can be provided in form of at least one, individually housed light-emitting diode or in form of at least one LED chip. Several LED chips can be mounted on a common substrate ("submount"). The at least one light-emitting diode can be equipped with at least one inherent and/or common optics for beam guidance, e.g. at least one Fresnel lens, collimator and so on. Instead of or additionally to inorganic light-emitting diodes, e.g. based on InGaN or AlInGaP, organic LEDs (OLEDs, e.g. polymer OLEDs) are also usable in general.

Alternatively, the at least one semiconductor light source can comprise e.g. at least one diode laser.

The optical refraction element can be a transparent element which can deflect light by refraction at its surfaces and which may also be designated as a lens then. The lens can be e.g. a Fresnel lens. As the optical refraction element presses the light generator onto the cooling element, the light generator can be held at the cooling element, where applicable, even without any further measures.

The refraction element being fastened on the cooling element can include that the optical refraction element is directly fastened on the cooling element, e.g. by a direct mechanical contact and/or material bond which effects the fastening. For example, a fastening region of the optical refraction element can be engaged with an opposite fastening region of the cooling element in a form-fit and/or friction-fit manner and/or be connected therewith in a firmly bonded manner. Then the light generator can be clamped or pressed in between the cooling element and the optical refraction element.

The refraction element being fastened at the cooling element can also include that the optical refraction element is indirectly fastened at the cooling element, e.g. by a mechanical contact and/or material bond with another element of the light module, between which the cooling element is mechanically arranged. For example, a fastening region of the optical refraction element can be engaged with an opposite fastening region of a light generator attached on a rear side of the cooling element. The cooling element can then be clamped between the light generator and the optical refraction element, and the light generator is pressed onto the rear side of the cooling element.

In one configuration the refraction element is fastened on the cooling element and is supported on the light generator. Thus, a reliable attachment of these elements, in particular of the light generator in a press-fit between the cooling element and the optical refraction element, can be achieved by simple means. The attachment of the refraction element on the cooling element can be provided e.g. by means of an adhesive or screw connection. In an especially cost-effective and compactly practicable further embodiment the refraction element is snapped onto or interlocked with the cooling element.

In an especially easily practicable and mountable embodiment the lens has at least one snap or lock hook protruding on the rear side which is locked with the cooling element, and the lens has at least one ("support") foot protruding on the rear side which is supported on the light generator. The cooling element can comprise corresponding lock recesses for an engagement with the lock hooks. The at least one foot can press the light generator onto the cooling element and moreover be used as a spacer. The lock hooks generate the related counter-pressure. In an alternative development the arrangement of cooling element and light generator can be reversed so that the at least one snap or lock hook protruding on the rear side is locked with the light generator and the at least one foot of the lens protruding on the rear side is supported on the cooling element.

In still another configuration the lock hook has an inclined contact surface (e.g. facing the cooling element). The point of contact between the lock hook and the cooling element is located on the contact surface. Thus, a contact pressure onto the light generator can be well adjusted in an easily practicable way.

In a further configuration a circuit board of the light generator directly lies on the cooling element, i.e. without any intermediate TIM film. This is enabled by the contact pressure onto the light generator. This configuration can advantageously be used especially for light modules comprising a rather low lighting performance. If, however, the lighting performance and therefore the heat generated by the at least one semiconductor light source is particularly so high that a thermal resistance between the cooling element and the light generator pressed thereon is too high to ensure a sufficient cooling of the at least one semiconductor light source, a TIM ("Thermal Interface Material") film or the like can additionally be arranged between the light generator and the cooling element. The TIM film can also be used as a holding film for connecting the light generator with the cooling element.

In still another configuration the driver is electrically connected with the light generator by at least one solder pin protruding through the cooling element. Thus, for example an especially flat design of the light module can be achieved. Thereby, particularly a circuit board of the driver ("driver circuit board") can be arranged parallel to the cooling element. By using several (e.g. two, three, four, etc.) solder pins an especially high stability of the connection can be achieved. The solder pins thus provide a mechanical and electrical connection. Alternatively, in a reversed arrangement of cooling element and light generator a feedthrough through the cooling element can be omitted.

In a further configuration the driver is pressed into the cooling element. Thus, a high mechanical stability can be achieved by especially simple means. Then the driver can be soldered to and hence electrically connected with the light generator particularly through its plugged-in portions. An influence on the associated solder connection by mechanical stress on the driver circuit board (e.g. during a transport) is largely avoided by the pressing-in. The driver can in particular be arranged upright. This can be understood such that the driver circuit board is perpendicular to the cooling element.

In a further embodiment the light module is glued to the housing. This results in the advantage that a tolerance compensation between the light module and the housing can be realized by an adjusting adhesive thickness. Thus, one can forgo very narrow tolerances of the elements to be glued.

It is also a configuration that the cooling element comprises an in particularly oblique sidewall to be placed against the housing, the front edge of which is rounded outwards. Thereby, an adhesive can be picked up from an inside of the housing while inserting the light module into the housing, and thus an excess of adhesive can be pushed downwards or into the housing. This enables an especially exact tolerance compensation via the adhesive thickness.

Additionally or alternatively, the light module can be fixed at the housing in a different way, e.g. by locking, screwing together etc.

The object is also solved by a semiconductor lamp comprising a housing open at the front into which the light module is inserted from the front side as described above and on which the light module is attached. Thus, a coupling to a finished semiconductor lamp can be achieved in a few steps. The housing can consist e.g. of glass or plastics. Such a semiconductor lamp is especially inexpensive and can be produced with high throughput. The semiconductor lamp can be configured in analogue to the light module and comprise the same advantages.

The housing can comprise a base at the rear, e.g. a pin base. The pin base can be a bipin base, for example of the type GU4, GU5.3 or GU10.

In a configuration the light module is glued to the housing, and an adhesive is present between the cooling element of the light module, in particular its lateral edge, and the housing.

It is still another configuration that a semiconductor lamp is a MR11, MR16 or PAR16 retrofit lamp. However, the semiconductor lamp can, for example, also be a bulb retrofit lamp etc.

Furthermore, the object is solved by a method for producing a semiconductor lamp as described above, wherein at least the driver, the cooling element, the light generator and the refraction element are assembled to an independently manageable light module and the light module is then inserted into a housing. The method can be implemented in analogue to the light module and/or to the semiconductor lamp and have the same advantages.

It is a configuration that an adhesive is applied to an inner side of the housing and the light module is then inserted into the housing such that the cooling element of the light module with its rounded front edge at least partially takes along the adhesive during its movement.

The above-described characteristics, features and advantages of this invention as well as the way in which these will be achieved become more obvious and clearer in connection with the following schematic description of embodiments which will be explained in more details in connection with the drawings. Same elements or elements with the same effects may be provided with the same reference numbers for the sake of clarity.

Figure 1:
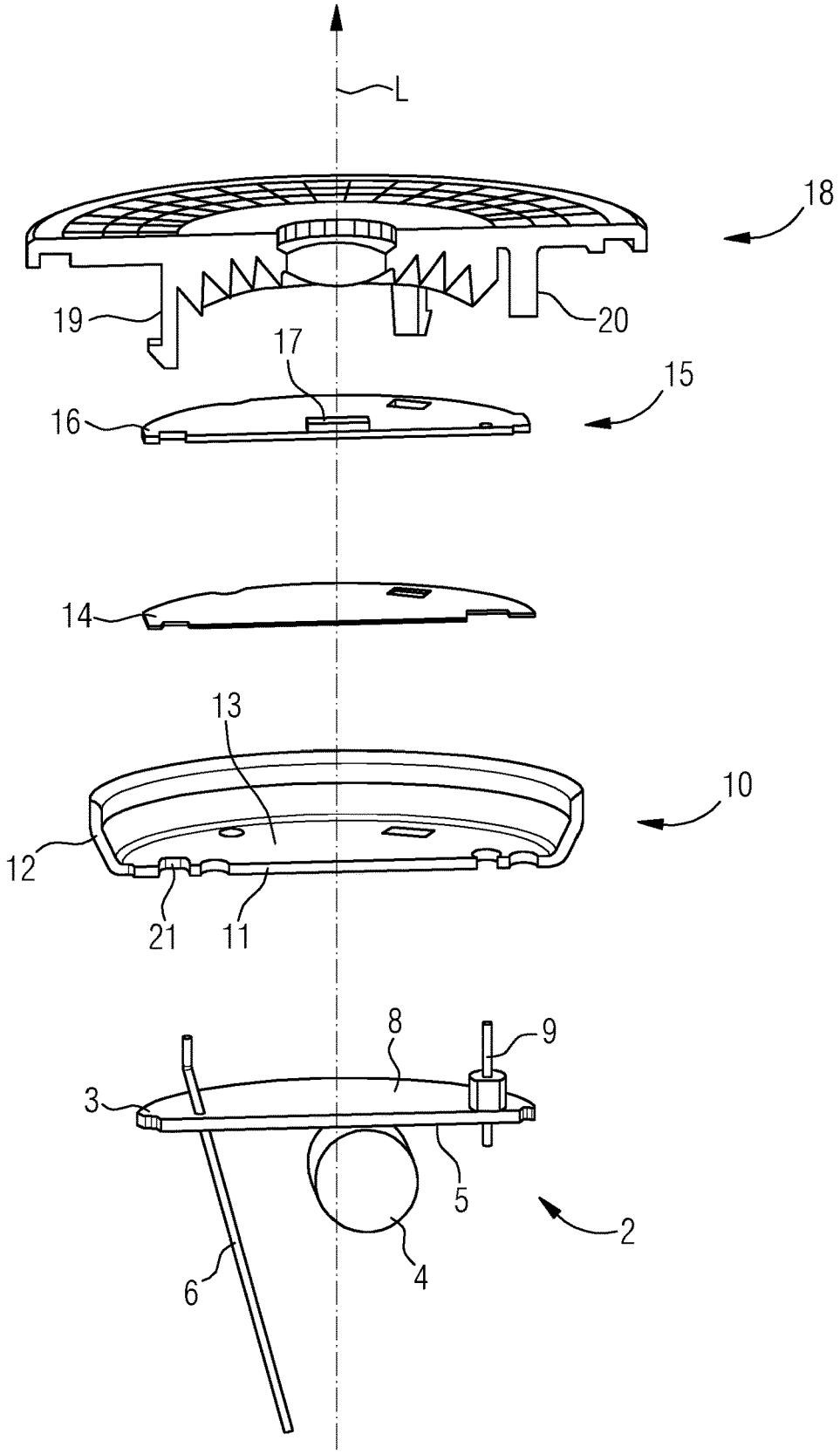
FIG. 1 shows the individual components to be assembled into a light module according to a first embodiment, as an exploded side view in cross section.

FIG. 1 shows the individual components to be assembled into a light module 1 (see FIG. 2 or FIG. 3) in an exploded side view in cross section. These components comprise a driver 2 with a driver circuit board 3 orientated perpendicular to a longitudinal axis L. Electrical and/or electronic elements 4 are arranged on the driver circuit board, namely in particular on a rear side 5. Electrically conductive contact wires 6 are extending from the rear side 5, namely in direction to and for contacting contact pins 7 (see FIG. 5). A front side 8 of the driver circuit board 3 is equipped with solder pins 9 protruding forward (in longitudinal direction L).

A further component is a cup-like cooling element 10 with a circular disc-shaped flat bottom 11 orientated perpendicular to the longitudinal axis L and a lateral sidewall 12 extending forwards.

A TIM film 14 is arranged at a front side 13 of the bottom 11.

At the front side of the TIM film 14 a light generator 15 is arranged which comprises a circuit board 16 orientated perpendicular to the longitudinal axis L as well as a semiconductor light source in form of a LED 17 arranged on the front side and centrally.

A transparent refraction element in form of a lens 18 is present as the foremost component. The lens 18 has lock hooks at the rear or protruding backwards and at least one (support) foot 20 protruding backwards.

Figure 2:
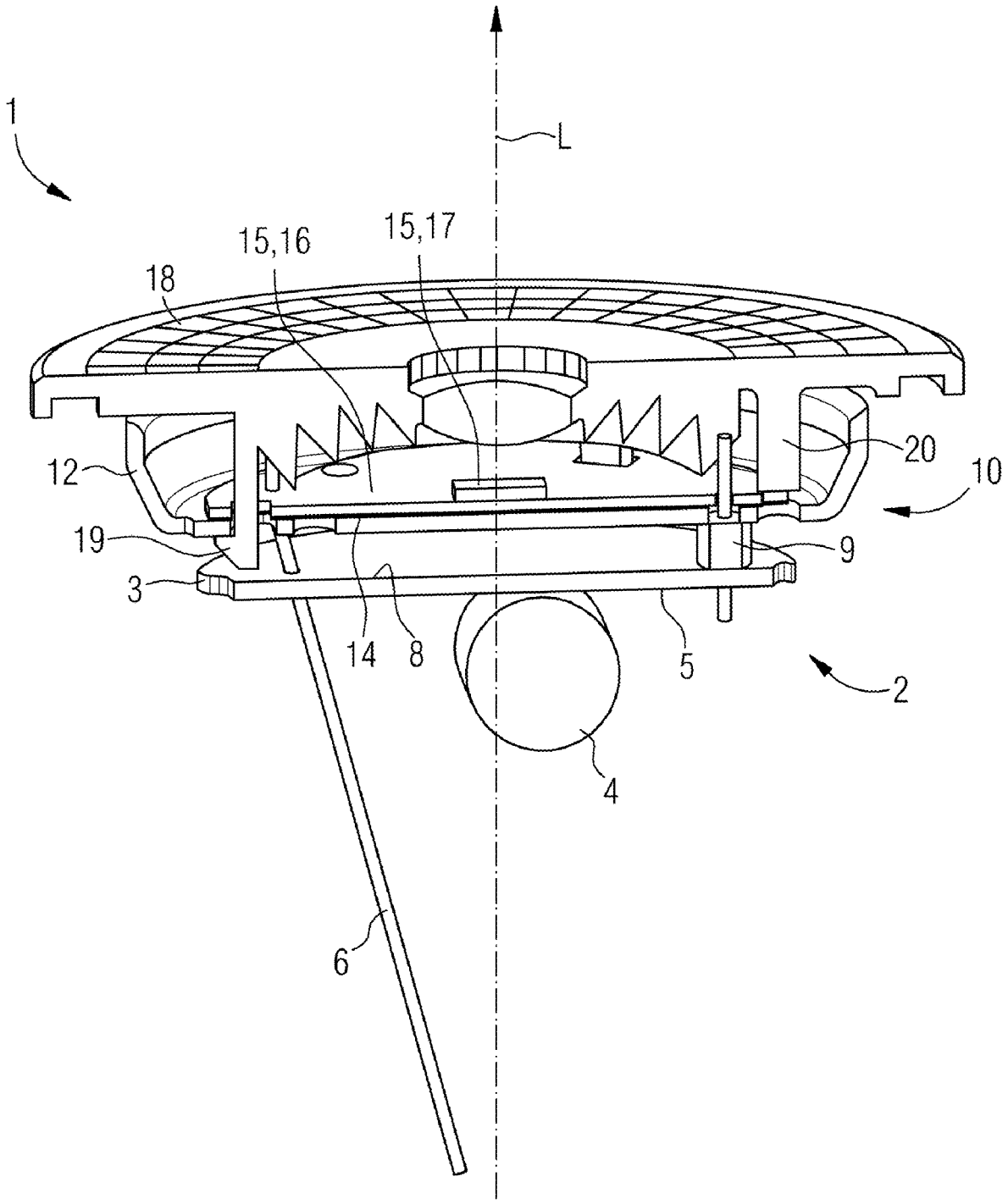
FIG. 2 shows the light module assembled from the components of FIG. 1 according to the first embodiment in a cross-sectional oblique view from above.
Figure 3:
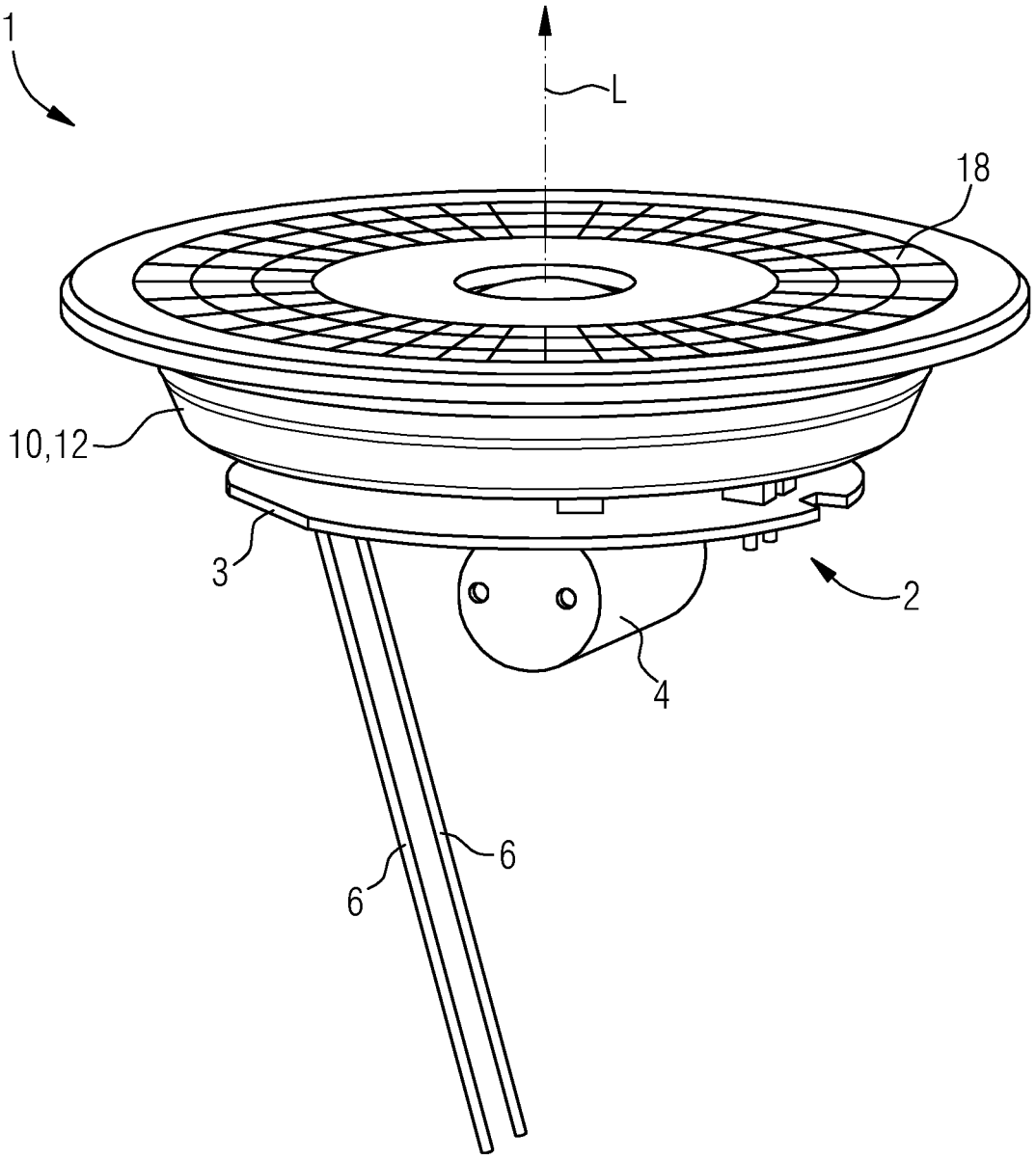
FIG. 3 shows the light module according to the first embodiment in an oblique view from above.

FIG. 2 shows the light module 1 assembled from the components 2, 10, 14, 15 and 18 in a cross-sectional oblique view from above. FIG. 3 shows the assembled light module 1 in an oblique view from above. The assembled light module 1 can be handled independently, e.g. produced and transported separately.

The light module 1 is constructed such that the driver 2 is electrically connected with the circuit board 16 of the light generator 15 by the solder pins 9 and thus also fastened on the light generator 15. The solder pins 9 protrude through corresponding holes in the cooling element 10. With regard to the cooling element 10, the driver 2 is arranged backwards and the light generator 15 is arranged at the front side. With the rear side of its circuit board 16 the light generator 15 lies on the front side 13 of the bottom of the cooling element 10 via the TIM film 14.

The lens 18 covers the LED 17 and is locked with the cooling element 10 by means of the lock hooks 19 engaging with corresponding lock openings 21 located in the bottom 11 (see FIG. 1) of the cooling element 10. The at least one foot 20 lies on the circuit board 16 of the light generator 15 at the front side and presses it towards the cooling element 10. The lens 18 or its foot 20 is thus supported on the light generator 15.

Figure 4A:
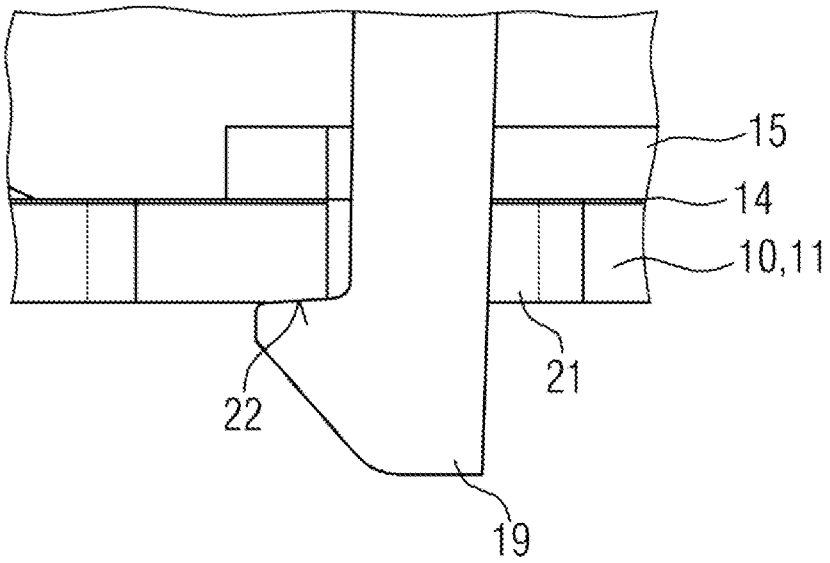
FIG. 4A shows a first section of FIG. 2.

As shown enlarged in FIG. 4A, the lock hook 19 is configured slightly inclined at its contact surface 22 facing the cooling element 10. This facilitates a self-acting adjustment to a desired contact force.

Figure 4B:
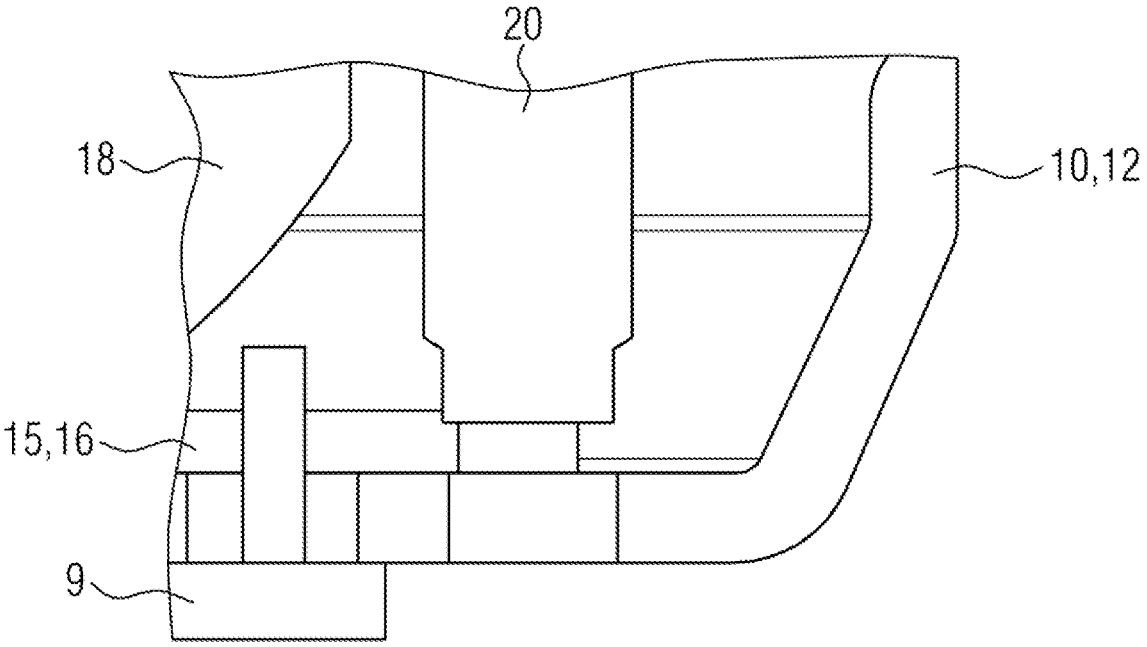
FIG. 4B shows a second section of FIG. 2.

FIG. 4B shows in an enlarged view that the foot 20 lies on the circuit board 16 of the light generator 15 at the front side and presses it towards the cooling element 10. The lens 18 or its foot 20 is thus supported on the light generator 15.

Figure 5:
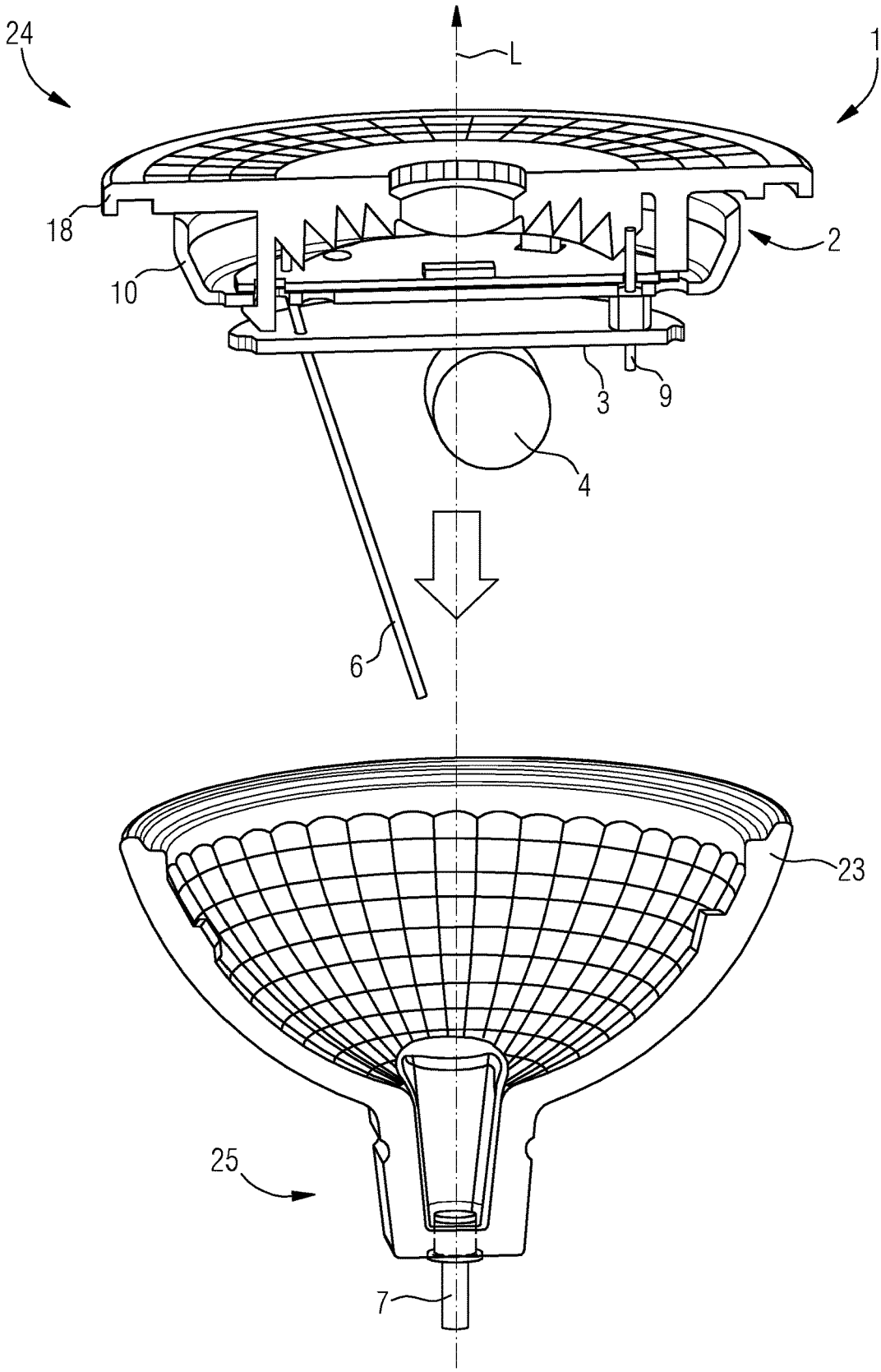
FIG. 5 shows the light module according to the first embodiment with a housing of a semiconductor lamp in a cross-sectional oblique view from above.

FIG. 5 shows the light module 1 with a housing 23 of a semiconductor lamp 24 in a cross-sectional oblique view from above. Here, the semiconductor lamp 24 is a retrofit lamp for replacement of a MR16 halogen lamp with a base 25 of the type GU5.3. For the final production of the semiconductor lamp 24 the light module 1 is inserted into the housing 23 from the front, as indicated by the arrow, and fastened e.g. by gluing. In particular, an adhesive can be located between the cooling element 10 of the light module 1 and the housing 23. In the process, the contact wires 6 are inserted into the contact pins 7 and fastened there e.g. by crimping the contact pins 7, by soldering and/or by welding. For this purpose, the contact pins 7 can internally be hollow.

Figure 6:
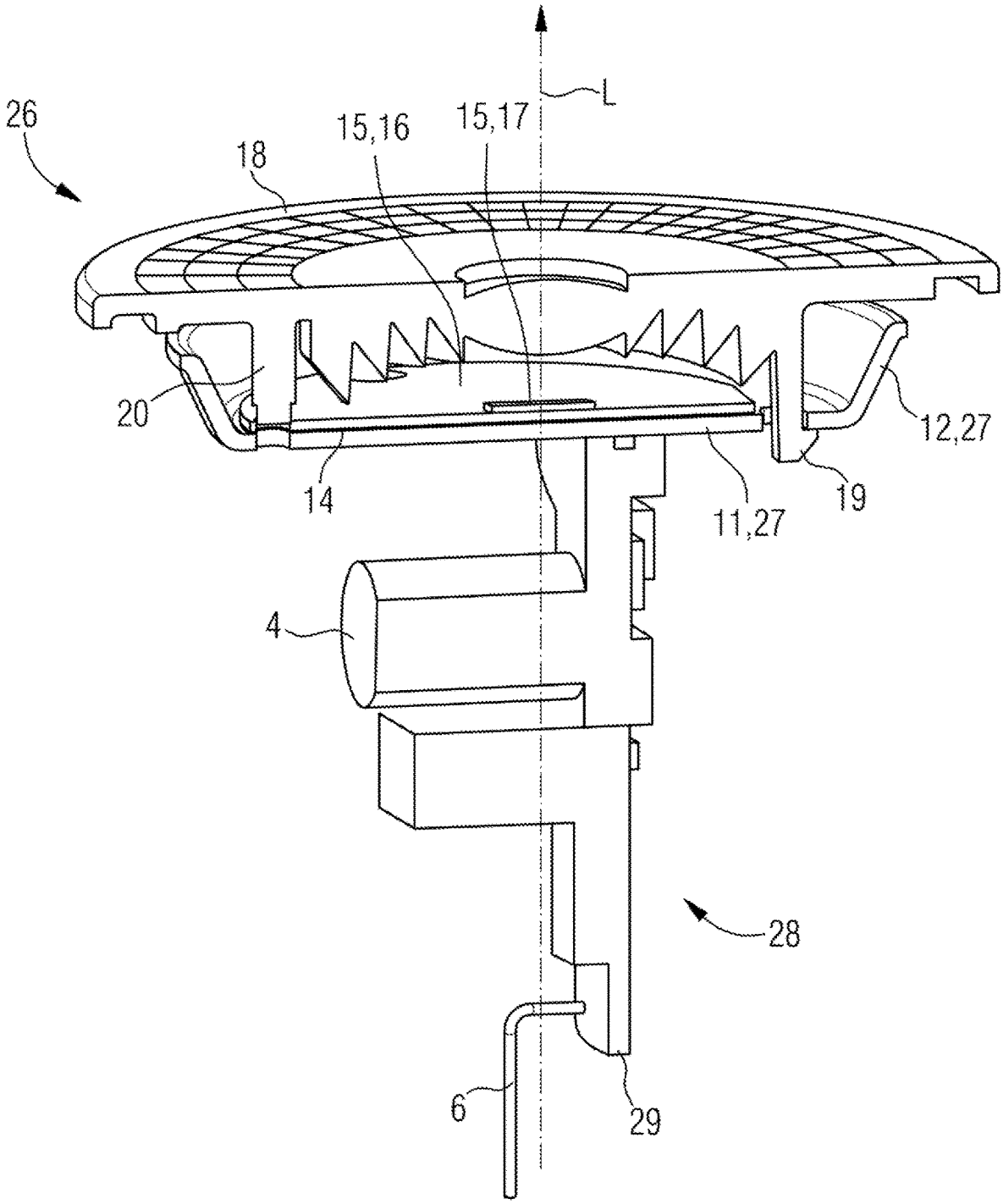
FIG. 6 shows an assembled light module according to a second embodiment in a cross-sectional oblique view from above.
Figure 7:
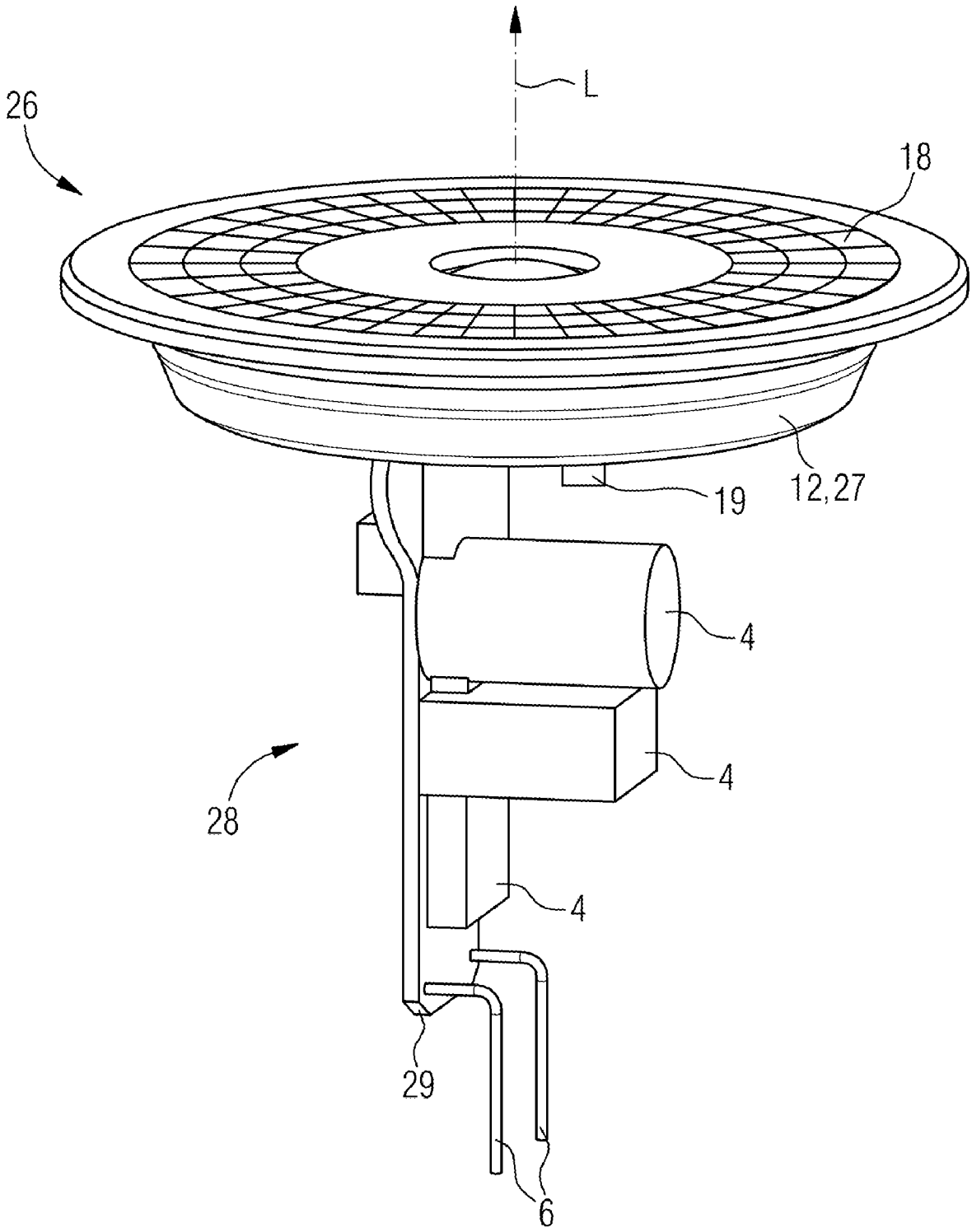
FIG. 7 shows the light module according to the second embodiment in an oblique view from above.

FIG. 6 shows an assembled light module 26 according to a second embodiment in a cross-sectional oblique view from above. The light module 26 is constructed similar to the light module 1, but comprises a driver 28 vertically to the cooling element 27. More precisely, the related driver circuit board 29 is vertical to the bottom 11 of the cooling element 22 and thus parallel to the longitudinal axis L. FIG. 7 shows the light module 26 in an oblique view from above.

Figure 8:
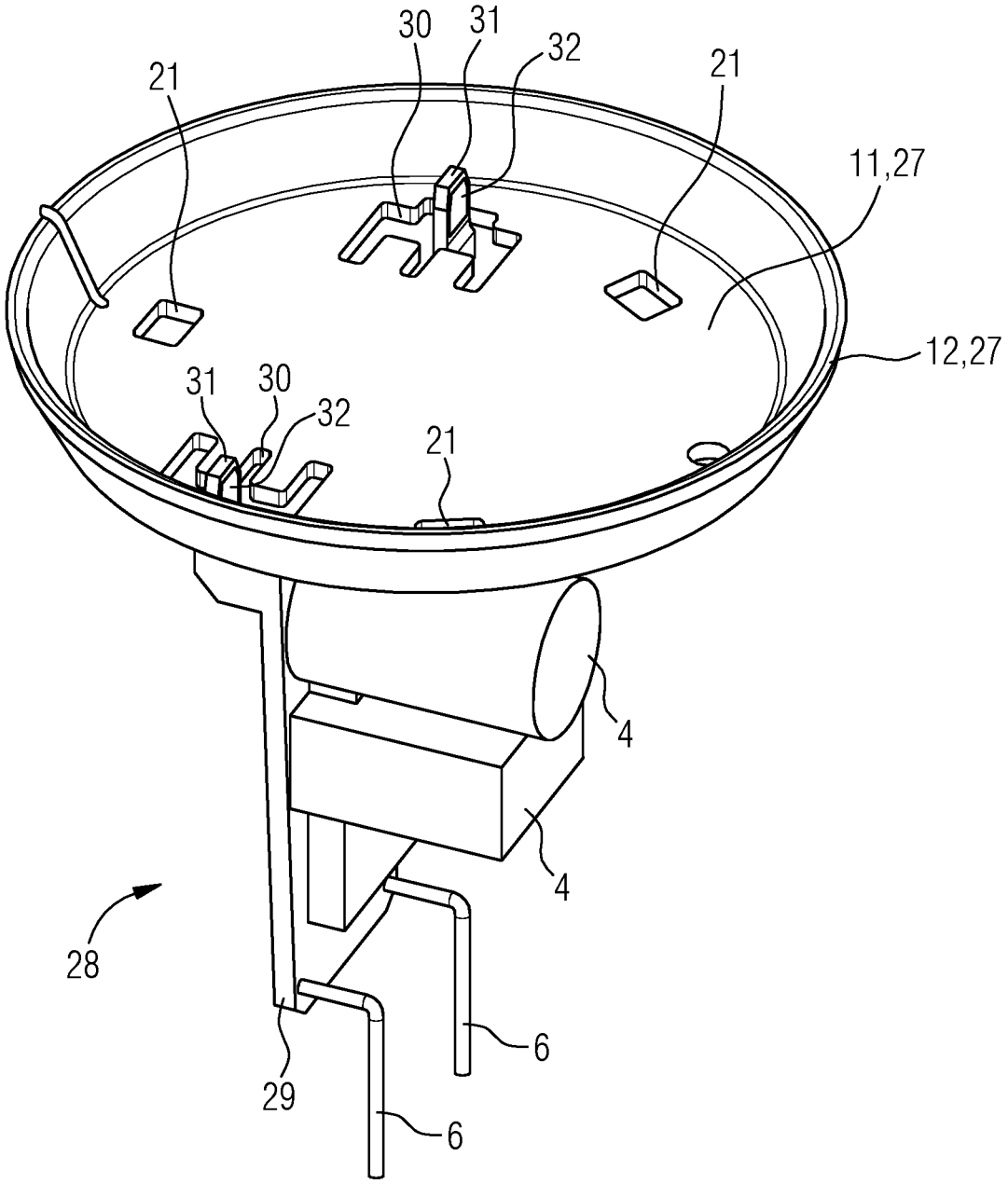
FIG. 8 shows a driver and a cooling element of the light module according to the second embodiment in an oblique view from above.

FIG. 8 shows the driver 28 and the cooling element 27 in an oblique view from above. In the bottom 11 of the cooling element 27 two slot-like feedthroughs 30 are present through each of which one contact tab 31 protruding from the driver circuit board 29 at the front side protrudes respectively. Conducting paths 32 spaced from the cooling element 27 are present at each respective contact tab 31. The contact tabs 31 are pressed into the feedthroughs 30 for mechanical fastening, and their conducting paths 32 are soldered to the light generator 15 (not shown) to provide an at least electrical connection to the light generator 15.

Figure 9A:
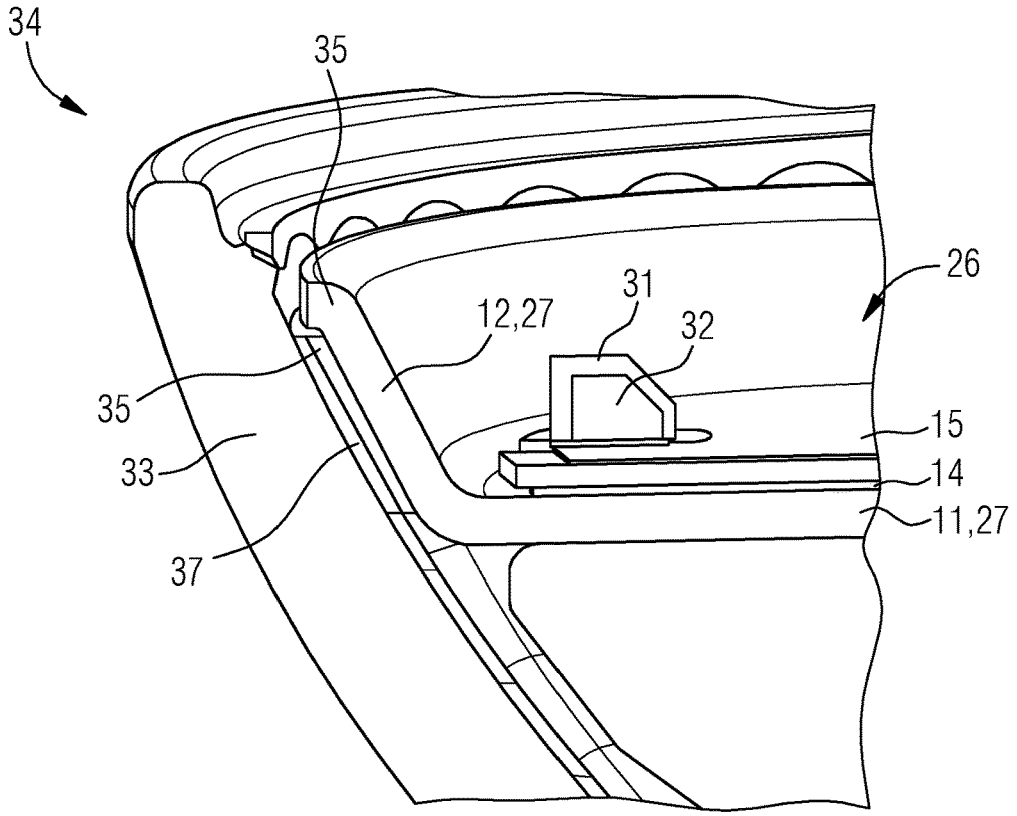
FIG. 9A shows a section of the light module according to the second embodiment which is inserted into a housing of another semiconductor lamp.
Figure 9B:
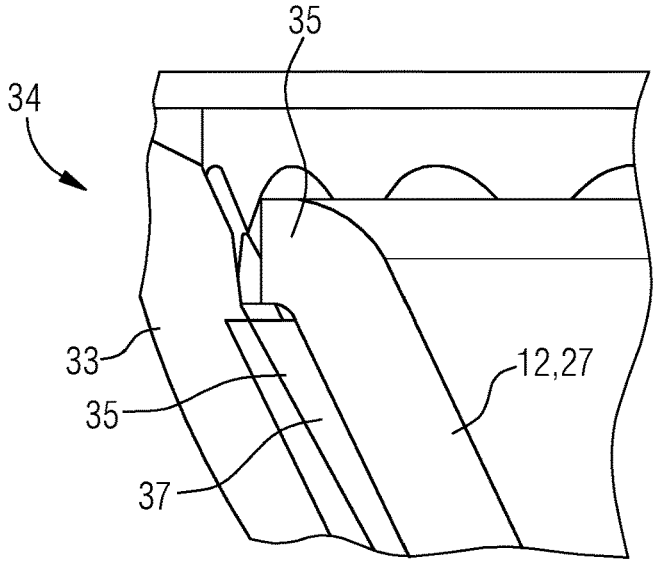
FIG. 9B shows a section of FIG. 9A.
Figure 10:
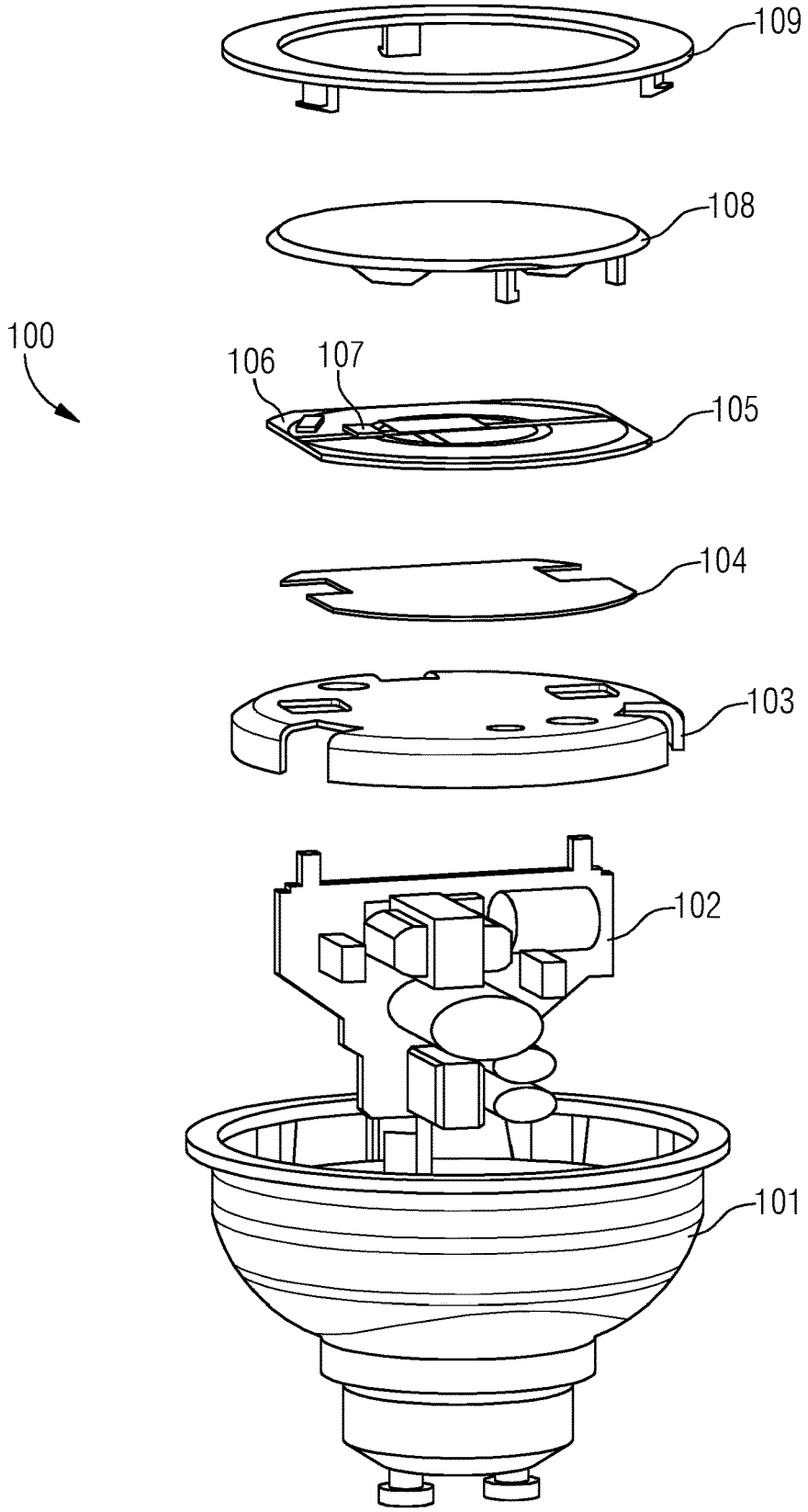
FIG. 10 shows the individual components to be assembled into a light module according to the prior art, as an exploded side view in cross section.

FIG. 9A shows a section of the light module 26 inserted into a housing 33 to form another semiconductor lamp 34. FIG. 9B shows an enlarged section of FIG. 9A in the region of a sidewall 12 of the cooling element 27.

The sidewall 12 of the cooling element 27 and also of the cooling element 10 is laterally rounded outwards at its front edge 35 and thus forms an outwardly bent collar. The sidewall 12 has a slightly smaller inclination to the longitudinal axis L at the outside up to the front edge 35 than the opposite internal wall of the housing 33. Therefore, a gap 36 is formed between them.

For producing the semiconductor lamp 33, an adhesive 37 can be applied to the inner side of the housing 33, namely at a front portion which can also be opposite to the sidewall 12. If now the light module 26 or 1 is inserted into the housing 33 or 23, respectively, the front edge 35 can at least partially take along the adhesive 37. Thereby, excessive adhesive 37 is removed which would otherwise remain in front of the sidewall 12 of the cooling element 10. This adhesive 37 can gather in the gap 36 and thereby additionally provide a tolerance compensation.

Although the invention was illustrated and described in detail by the shown embodiments, the invention is not limited thereto, and other variations can be derived from this by those skilled in the art without leaving the scope of the invention.

For example, the driver circuit board 3 need not be spaced from the cooling element 10 (as e.g. shown in FIG. 2, where the solder pins 9 serve as spacers), but can also two-dimensionally abut the cooling element 10 or lie thereon with its front side.

The light generator—for example as a variant of the light module 1—can also abut the cooling element over a surface at the rear side, e.g. with a front side of the circuit board of the light generator directly or indirectly (e.g. via a thin TIM film) contacting a rear side of the cooling element over a surface. For this purpose, the cooling element can comprise a central recess for the LED. In particular, in this case the lock hooks can engage with the lock openings of the circuit board and thus press the light generator from below or rearward onto the cooling element. The cooling element can comprise respective recesses for passing of the lock hooks. The at least one foot can be supported on an upper side of the cooling element.

Generally, "a", "an" etc. may be understood as singular or plural, in particular in terms of "at least one" or "one or more" etc., as long as this is not excluded explicitly, e.g. by the term "exactly one" etc.

Numerical data may also include the given number exactly as well as a usual tolerance range as long as this is not excluded explicitly.

REFERENCE NUMERALS light module 1
driver 2
driver circuit board 3
element 4
rear side of the driver circuit board 5
contact wire 6
contact pin 7
front side of the driver circuit board 8
solder pin 9
cooling element 10
bottom 11
sidewall 12
front side of the bottom 13
TIM film 14
light generator 15
circuit board of the light generator 16
LED 17
lens 18
lock hook 19
foot 20
lock opening 21
contact surface 22
housing 23
semiconductor lamp 24
base 25
light module 26
cooling element 27
driver 28
driver circuit board 29
feedthrough 30
contact tab 31
conductive path 32
housing 33
semiconductor lamp 34
front edge 35
gap 36
adhesive 37
conventional MR16 retrofit lamp 100
housing 101
driver 102
cooling element 103
TIM film 104
LED module 105
circuit board 106
LED 107
lens 108
lens holder 109
longitudinal axis L

The invention claimed is:

1. A light module configured for insertion into a housing of a semiconductor lamp, the light module comprising:

a driver;

a cooling element;

a light generator abutting the cooling element, the light generator comprising at least one semiconductor light source populated on a circuit board and electrically connected with the driver; and an optical refraction element covering the at least one semiconductor light source, wherein the optical refraction element includes:

a first structure extending through a bottom wall of the cooling element and engaging the cooling element so that the optical refraction element is fastened on the cooling element; and a second structure that presses the light generator onto the cooling element.

2. The light module according to claim 1, wherein the optical refraction element is fastened on the cooling element and is supported on the light generator.

3. The light module according to claim 1, wherein:

the first structure comprises at least one lock hook protruding at a rear of the optical refraction element, which is locked with the cooling element; and the second structure comprises at least one foot protruding at the rear of the optical refraction element, which is supported on the light generator.

4. The light module according to claim 1, wherein the circuit board of the light generator directly abuts the cooling element.

5. The light module according to claim 1, wherein the driver is connected with the light generator through solder pins.

6. The light module according to claim 1, wherein the driver is pressed into the cooling element and soldered to the light generator.

7. The light module according to claim 1, wherein the cooling element has an inclined sidewall configured to be placed against the housing, a front edge of which is rounded outwards.

8. A semiconductor lamp comprising:

the light module according to claim 1; and a housing open at a front side thereof, into which the light module is inserted at the front side and at which the light module is fastened.

9. The light module according to claim 1, wherein the cooling element is cup-shaped, the bottom wall of which is flat, and wherein the light generator abuts the flat bottom wall.

10. The light module according to claim 1, wherein the cooling element and the optical refraction element interface to enclose the light generator in a space defined by such enclosure.

11. The light module according to claim 1, wherein the cooling element is shorter in height than a length of the first structure.

12. The light module according to claim 1, wherein the second structure terminates within an interior space of the cooling element.

13. The light module according to claim 1, wherein in extending through the bottom wall of the cooling element and engaging the cooling element, the first structure passes through a first through-hole defined in the circuit board and a second through-hole defined in the cooling element.

14. The light module according to claim 1, wherein the first structure extends through the circuit board.

15. The light module according to claim 1, wherein:

a thermal interface material layer is sandwiched between the circuit board and the cooling element; and the first structure extends through the thermal interface material layer.

16. The light module according to claim 1, wherein the optical refraction element including the first structure and the second structure is formed as a single-piece body.

17. The light module according to claim 3, wherein the at least one lock hook has an inclined contact surface configured to engage with the bottom wall of the cooling element.

18. The semiconductor lamp according to claim 8, wherein the cooling element has an inclined sidewall configured to be placed against the housing, a front edge of which is rounded outwards, wherein the light module is glued to the housing via an adhesive present between the cooling element of the light module and the housing.

19. The semiconductor lamp according claim 8, wherein the semiconductor lamp is a MR16 or PAR16 retrofit lamp.

20. A method for producing a semiconductor lamp, the method comprising:

providing a light module configured for insertion into a housing of the semiconductor lamp, the light module comprising:

a driver;

a cooling element;

a light generator, abutting the cooling element, with at least one semiconductor light source electrically connected with the driver; and an optical refraction element covering the at least one semiconductor light source, wherein the optical refraction element is fastened on the cooling element and presses the light generator onto the cooling element;

wherein the cooling element has an inclined sidewall configured to be placed against the housing, a front edge of which is rounded outwards; and inserting the light module into a housing of the semiconductor lamp, wherein the housing is open at a front side thereof, into which housing the light module is inserted at the front side and at which the light module is fastened, wherein the light module is glued to the housing via an adhesive present between the cooling element of the light module and the housing, wherein the adhesive is applied to an inner side of the housing and then the light module is inserted into the housing such that the cooling element of the light module with the front edge which is rounded outwards at least partially takes along the adhesive during its movement;

wherein at least the driver, the cooling element, the light generator, and the optical refraction element are assembled to provide the light module and then the light module is inserted into the housing.

* * * * *